US008330100B2

(12) United States Patent
Satoh

(10) Patent No.: US 8,330,100 B2
(45) Date of Patent: Dec. 11, 2012

(54) METHOD AND APPARATUS FOR TANDEM TIME-OF-FLIGHT MASS SPECTROMETRY

(75) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 13/221,976

(22) Filed: Aug. 31, 2011

(65) Prior Publication Data

US 2012/0068062 A1 Mar. 22, 2012

(30) Foreign Application Priority Data

Sep. 22, 2010 (JP) ..... 2010-211827

(51) Int. Cl.
*H01J 49/40* (2006.01)
*H01J 49/00* (2006.01)

(52) U.S. Cl. ..... 250/287; 250/286; 250/288; 250/299

(58) Field of Classification Search ..... 250/281, 250/282, 283, 286, 287, 288, 299, 300
See application file for complete search history.

(56) References Cited

U.S. PATENT DOCUMENTS

2007/0051886 A1* 3/2007 Rather ..... 250/288
2009/0026365 A1* 1/2009 Satoh ..... 250/287

FOREIGN PATENT DOCUMENTS

GB 2080021 A 1/1982
JP 2000243345 A 9/2000
JP 200386129 A 3/2003
JP 2005302728 A 10/2005
JP 200612782 A 1/2006
WO 2005001878 A2 1/2005

OTHER PUBLICATIONS

Toyoda et al., "Multi-turn time-of-flight mass spectrometers with electrostatic sectors", Journal of Mass Spectrometry, 2003, pp. 1125-1142, vol. 38.

* cited by examiner

*Primary Examiner* — Bernard E Souw
(74) *Attorney, Agent, or Firm* — The Webb Law Firm

(57) ABSTRACT

Tandem time-of-flight mass spectrometry method and apparatus permits an ion gate to be time set optimally at all times if the instrumental conditions are modified. Delayed extraction conditions for the mass-to-charge ratios of plural reference substances and optimum values of the time for which the ion gate is opened are measured and stored in a data table. Delayed extraction conditions and opening time of the ion gate which optimize the mass resolution at the mass-to-charge ratio of the desired precursor ions are found based on values stored in the table.

11 Claims, 4 Drawing Sheets

| | ADJUSTABLE PARAMETER | |
|---|---|---|
| m/z | DELAYED EXTRACTION PARAMETER | ION GATE-ADJUSTING VALUE |
| Mb | Pc | ΔMc |
| Ma | Pa | 0 |
| Mc | Pb | ΔMb |
| | | |
FIG. 7
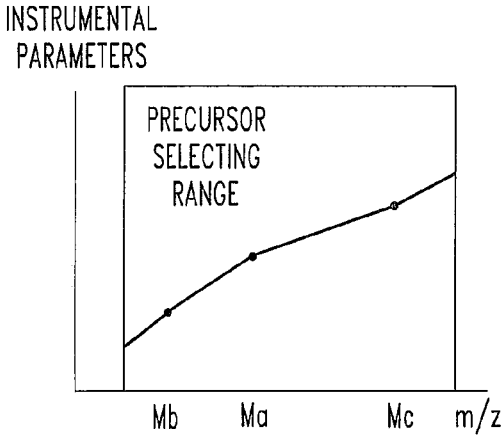
FIG. 8A
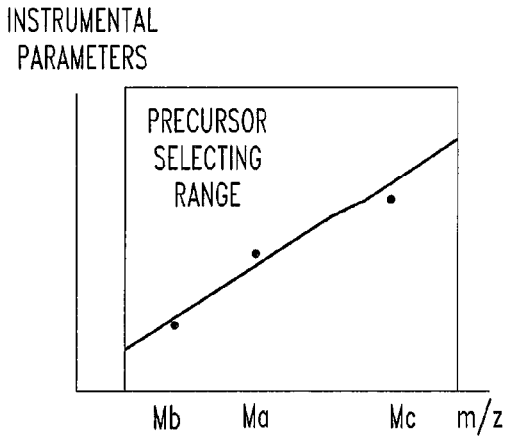
FIG. 8B
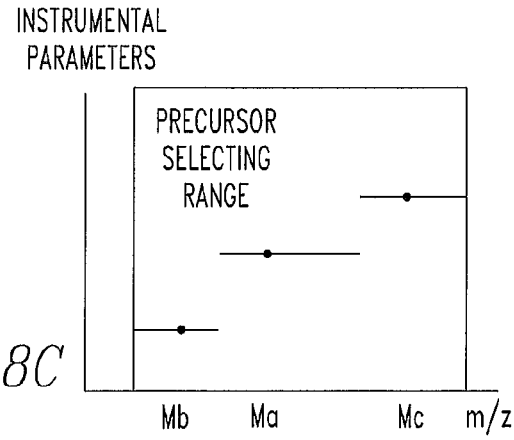
FIG. 8C

METHOD AND APPARATUS FOR TANDEM TIME-OF-FLIGHT MASS SPECTROMETRY

BACKGROUND OF THE INVENTION

1. Field of the Invention

The present invention relates to a method of tandem time-of-flight mass spectrometry used in quantitative analysis and quantitative simultaneous analysis of trace compounds and also in structural analysis of sample ions.

2. Description of Related Art

[Time-of-Flight Mass Spectrometer (TOF-MS)]

TOF-MS is an instrument for finding the mass-to-charge ratio of an ion by imparting a given amount of energy to the ion to accelerate it such that it travels and by measuring the time taken until the ion reaches a detector. In TOF-MS, an ion is accelerated with a given pulsed voltage $V_a$. At this time, from the law of conservation of energy, the velocity v of the ion is given by $$mv^2/2 = qeV_a \tag{1}$$

$$v = \sqrt{\frac{2qeV}{m}} \tag{2}$$

where m is the mass of the ion, q is the electric charge of the ion, and e is the elementary charge. The ion reaches a detector, placed at a given distance of L, in a flight time T. The flight time is given by $$T = L/v = L\sqrt{\frac{m}{2qeV}} \tag{3}$$

TOF-MS is an instrument that separates masses by making use of the fact that the flight time T differs according to different ion mass in as indicated by Eq. (3). One example of linear TOF-MS is shown in FIG. 1. Furthermore, reflectron TOF mass spectrometers capable of providing improved energy focusing and elongating the flight distance by placing a reflectron field between an ion source and a detector are widely used. One example of reflectron TOF-MS is shown in FIG. 2.

[Helical Orbit TOF-MS]

The mass resolution of TOF-MS is defined to be $$\text{mass resolution} = \frac{T}{2\Delta T} \tag{4}$$

where T is the total flight time and ΔT is a peak width. That is, if the peak width ΔT is made constant and the total flight time T can be lengthened, the mass resolution can be improved. However, in the related art linear or reflectron type TOF-MS, increasing the total flight time T (i.e., increasing the total flight distance) will lead directly to an increase in instrumental size. A multi-pass time-of-flight mass spectrometer has been developed to realize high mass resolution while avoiding an increase in instrumental size (see M. Toyoda, D. Okumura, M. Ishihara and I. Katakuse, *J. Mass Spectrum.,* 2003, 38, pp. 1125-1142). This instrument uses four toroidal electric fields each consisting of a combination of a cylindrical electric field and a Matsuda plate. The total fight time T can be lengthened by accomplishing multiple turns in an 8-shaped circulating orbit. In this apparatus, the spatial and temporal spread at the detection surface has been successfully converged up to the first-order term using the initial position, initial angle, and initial kinetic energy.

However, the TOF-MS in which ions revolve many times around a closed trajectory suffers from the problem of overtaking. That is, because ions revolve multiple times round a closed trajectory, lighter ions moving at higher speeds overtake heavier ions moving at smaller speeds. Consequently, the fundamental concept of TOF-MS that ions arrive at the detection surface in turn from the lightest one does not hold.

The spiral-trajectory TOF-MS has been devised to solve this problem. The spiral-trajectory TOF-MS is characterized in that the starting and ending points of a closed trajectory are shifted from the closed trajectory plane in the vertical direction. To achieve this, in one method, ions are made to impinge obliquely from the beginning (see JP-A-2000-243345). In another method, the starting and ending points of the closed trajectory are shifted in the vertical direction using a deflector (see JP-A-2003-86129). In a further method, laminated toroidal electric fields are used (see JP-A-2006-12782).

Another TOF-MS has been devised which is based on a similar concept but in which the trajectory of the multi-turn TOF-MS (see GB2080021) where overtaking occurs is zigzagged (see WO 2005/001878 pamphlet).

[MALDI Method and Delayed Extraction]

Matrix-assisted laser desorption/ionization (MALDI) is available as one type of ion source for TOF-MS. An instrument in which the MALDI method and TOF-MS are combined is referred to as MALDI-TOFMS. In the MALDI method, a sample is mixed and dissolved in a matrix (liquid, crystalline compound, metal powder, or the like) having an absorption band at the used laser light wavelength and solidified. The solidified sample is irradiated with laser light to vaporize or ionize the sample. In a laser-induced ionization process typified by the MALDI method, the initial energy distribution occurring when ions are created is wide. In order to converge the distribution in terms of time, delayed extraction is employed in most cases. This process consists of applying a pulsed voltage after a delay of hundreds of nanoseconds since laser irradiation. The performance of the MALDI-TOFMS has been improved greatly by adoption of the delayed extraction.

A general MALDI ion source and delayed extraction are conceptually illustrated in FIG. 3. A sample is mixed and dissolved in a matrix (such as liquid, crystalline compound, or metal powder) and solidified. The solid sample is placed on a sample plate. To permit the state of the sample to be observed, lens 2, mirror 2', and a CCD camera are disposed. Laser light is directed at the sample through lens 1 and mirror 1' to vaporize or ionize the sample. The created ions are accelerated by voltages applied to accelerating electrode 10 and a base electrode (accelerating electrode 20) and introduced into a mass analyzer.

The sequence of TOF measurement steps employing delayed extraction is also illustrated in FIG. 3. First, the accelerating electrode 10 and the sample plate are placed at the same potential of Vs. Then, a signal indicating laser oscillation is received from the laser. After a delay of hundreds of nsec, the potential Vs on the accelerating electrode 10 is quickly varied to V1 to create a potential gradient between the sample plate and accelerating electrode 10, for accelerating the resulting ions. The starting time of measurement of a flight time is synchronized with the rise time of a pulser.

[MS/MS Measurements and TOF/TOF Instrument]

In general mass analysis, ions generated by an ion source are separated according to their m/z by a mass analyzer and detected. The results are represented in the form of a mass spectrum in which m/z values and relative intensity of each ion are graphed. Information obtained at this time is only about masses. This measurement is herein referred to as an MS measurement in contrast with an MS/MS measurement in which certain ions (precursor ions) generated by an ion source are selected by a first stage of mass analyzer (MS1 in FIG. 4), the ions spontaneously fragment or are caused to fragment, and the generated ions (product ions) are mass analyzed by a subsequent stage of mass analyzer (MS2). An instrument enabling this is referred to as an MS/MS instrument.

In MS/MS measurements, the m/z values of precursor ions, the m/z values of product ions generated in plural fragmentation paths, and information about their relative intensity information are obtained and so structural information about the precursor ions can be obtained (FIG. 5). An MS/MS instrument in which two TOF-MS units are connected in tandem is generally known as a TOF-TOF instrument and mainly used in equipment using a MALDI ion source. In a related-art TOF-TOF instrument, a linear TOF-MS unit is adopted as a first TOF-MS unit and a reflectron TOF-MS unit is adopted as a second TOF-MS unit as shown in FIG. 6. An ion gate for selecting precursor ions is disposed between the first and second TOF-MS units. In the case of TOF-TOF, an electric field is normally applied to the ion gate. Under this condition, no ions are allowed to pass. The electric field is de-energized only when precursor ions to be selected pass. In JP-A-2005-302728, the precursor ions spontaneously fragment or are forced to fragment in a collision cell positioned before the reflectron field of the first or second TOF-MS unit.

The performance of the MALDI method has been improved by the employment of a delayed extraction technique. However, the delayed extraction technique has the disadvantage that the focal point differs slightly depending on the m/z value of ion. In the case of TOF-TOF, the focal point is present at the starting point of the second TOF-MS unit. Ion positions are distributed differently according to different m/z values. For example, if ions with some m/z value are focused at the starting point of the second TOF-MS unit, positions are distributed more widely as the m/z value goes away from that m/z value.

That is, if the instrumental conditions are so set that the ion mass resolution is enhanced at some m/z value, the ion mass resolution deteriorates with going away from that m/z value. In order to obtain a product ion spectrum of higher quality, it is important that the precursor ions be focused in the direction of axis of flight at the starting point of the second TOF-MS unit. Therefore, it is necessary to modify the instrumental conditions for each m/z value of precursor ions.

However, modifying the instrumental conditions affects the observed flight time. Consequently, the set value of the ion gate needs to be finely adjusted accordingly. In an instrument capable of providing especially high precursor ion selectivity, if only ions with a quite restricted range of m/z values are selected such as monoisotopic ions within precursor ions, it is quite important to adjust the time setting of the ion gate.

SUMMARY OF THE INVENTION

In view of the foregoing, it is an object of the present invention to provide a method and apparatus which is adapted for use in tandem time-of-flight mass spectrometry, is MALDI-TOFMS employing delayed extraction, and permits an ion gate to be time set optimally at all times if the instrumental conditions are varied.

This object is achieved by a method of tandem time-of-flight mass spectrometry associated with the present invention, the method being implemented by a tandem time-of-flight mass spectrometer having: an ion source for ionizing a sample by irradiating it with pulsed laser light to generate ions; acceleration means for extracting the generated ions in a pulsed manner and accelerating the ions by a pulsed accelerating voltage under certain delayed extraction conditions; a first time-of-flight ion optical system permitting the accelerated ions to travel; an ion gate for selecting only ions having a desired mass-to-charge ratio as precursor ions from among the ions mass-separated by the first time-of-flight ion optical system; fragmentation means for fragmenting the selected precursor ions into product ions; a second time-of-flight ion optical system disposed behind the fragmentation means and permitting the product ions to travel; and a detector for detecting ions passed through the second time-of-flight ion optical system. A data table is drawn up in preparation for measurements of product ions which are generated by selecting desired precursor ions by the ion gate and fragmenting the precursor ions. Optimum delayed extraction conditions for the mass-to-charge ratios of plural reference substances and optimum values of the time for which the ion gate is opened are measured and stored in the data table. Delayed extraction conditions and ion gate open time which optimize the mass resolution at the mass-to-charge ratio of the desired precursor ions are found based on the values stored in the table. The found optimum values of the delayed extraction conditions and ion gate open time are set into the tandem time-of-flight mass spectrometer.

In one feature of this method, the delayed extraction conditions include an ion acceleration voltage or a delay time from laser irradiation to the instant at which the ions are accelerated.

In another feature of the method, with respect to the delayed extraction conditions and ion gate open time, delayed conditions and ion gate open time adapted for desired ions are calculated by connecting points stored in the table by broken lines and interpolating between the points.

In a further feature of the method, with respect to the delayed extraction conditions and ion gate open time, delayed conditions and ion gate open time adapted for desired ions are calculated by approximating spaces between the points stored in the table by a polynomial equation and interpolating between the points.

In a yet other feature of the method, with respect to the delayed extraction conditions and ion gate open time, delayed conditions and ion gate open time adapted for desired ions are calculated by partitioning each space between any two adjacent ones of the points stored in the table into two subspaces and assigning respective ones of the m/z values stored in the table to the subspaces.

In a still other feature of the method, laser intensity or a detector voltage of the mass spectrometer is included as fine adjustment conditions, in addition to the delayed extraction conditions and ion gate open time.

In an additional feature of the method, the laser intensity or the detector voltage of the mass spectrometer is finely adjusted in step with the intensity of the precursor ions.

In a still further feature of the method, the ion source is a MALDI ion source.

In yet additional feature of the method, the first time-of-flight ion optical system is a time-of-flight ion optical system having precursor ion selectivity that has been enhanced by making use of a reflectron field or sector field.

In a yet another feature of the method, after a measurement, the mass positions of the precursor ions that have deviated due to setting of the delayed extraction conditions are corrected so as to conform with their original values based on m/z values of the precursor ions observed within a product ion spectrum.

A tandem time-of-flight mass spectrometer associated with the present invention has: an ion source for ionizing a sample by irradiating it with pulsed laser light to generate ions; acceleration means for extracting the generated ions in a pulsed manner and accelerating the ions by a pulsed accelerating voltage under certain delayed extraction conditions; a first time-of-flight ion optical system permitting the accelerated ions to travel; an ion gate for selecting only ions having a desired mass-to-charge ratio as precursor ions from among the ions mass-separated by the first time-of-flight ion optical system; fragmentation means for fragmenting the selected precursor ions into product ions; a second time-of-flight ion optical system disposed behind the fragmentation means and permitting the product ions to travel; and a detector for detecting ions passed through the second time-of-flight ion optical system. The tandem flight-of-time mass spectrometer comprises: a data table in which measured optimum values of delayed extraction conditions for mass-to-charge ratios of plural reference substances and measured optimum values of open time of the ion gate are stored; means for finding delayed extraction conditions and ion gate open time which optimize mass resolution for each mass-to-charge ratio of the precursor ions based on values stored in the table; and means for setting the optimum values of the delayed extraction conditions and ion gate open time into the tandem time-of-flight mass spectrometer according to the value of the mass-to-charge ratio of the selected precursor ions.

A method of tandem time-of-flight mass spectrometry associated with the present invention is implemented by a tandem time-of-flight mass spectrometer having: an ion source for ionizing a sample by irradiating it with pulsed laser light to generate ions; acceleration means for extracting the generated ions in a pulsed manner and accelerating the ions by a pulsed accelerating voltage under certain delayed extraction conditions; a first time-of-flight ion optical system permitting the accelerated ions to fly (or travel); an ion gate for selecting only ions having a desired mass-to-charge ratio as precursor ions from among the ions mass-separated by the first time-of-flight ion optical system; fragmentation means for fragmenting the selected precursor ions into product ions; a second time-of-flight ion optical system disposed behind the fragmentation means and permitting the product ions to travel; and a detector for detecting ions passed through the second time-of-flight ion optical system. The method starts with drawing up a data table in preparation for measurements of product ions which are generated by selecting desired precursor ions by the ion gate and fragmenting the precursor ions. Optimum conditions under which plural reference substances having different mass-to-charge ratios are subjected to delayed extraction and optimum values of the time for which the ion gate is opened are measured and stored in the data table. Delayed extraction conditions and ion gate open time which optimize the mass resolution at the mass-to-charge ratio of the desired precursor ions are found based on values stored in the table. The found optimum values of the delayed extraction conditions and ion gate open time are set into the tandem time-of-flight mass spectrometer. Consequently, if the instrumental conditions of the MALDI-TOFMS instrument utilizing delayed extraction are varied, a method of tandem time-of-flight mass spectrometry can be offered which permits the ion gate to be time set optimally at all times.

A tandem time-of-flight mass spectrometer associated with the present invention has: an ion source for ionizing a sample by irradiating it with pulsed laser light to generate ions; acceleration means for extracting the generated ions in a pulsed manner and accelerating the ions by a pulsed accelerating voltage under certain delayed extraction conditions; a first time-of-flight ion optical system permitting the accelerated ions to travel; an ion gate for selecting only ions having a desired mass-to-charge ratio as precursor ions from among the ions mass-separated by the first time-of-flight ion optical system; fragmentation means for fragmenting the selected precursor ions into product ions; a second time-of-flight ion optical system disposed behind the fragmentation means and permitting the product ions to travel; and a detector for detecting ions passed through the second time-of-flight ion optical system. The tandem time-of-flight mass spectrometer comprises: a data table in which measured optimum values of delayed extraction conditions for mass-to-charge ratios of plural reference substances and measured optimum values of open time of the ion gate are stored; means for finding delayed extraction conditions and ion gate open time which optimize the mass resolution for each mass-to-charge ratio of the precursor ions based on values stored in the table; and means for setting optimum values of the delayed extraction conditions and ion gate open time into the tandem time-of-flight mass spectrometer according to the value of the mass-to-charge ratio of the selected precursor ions. Consequently, if the instrumental conditions of the MALDI-TOFMS employing delayed extraction are varied, a tandem time-of-flight mass spectrometer can be offered which permits the ion gate to be time set optimally at all times.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIG. 7 is an adjustment table associated with the present invention; and

FIG. 8 illustrates a method of using the adjustment table associated with the invention.

DESCRIPTION OF THE PREFERRED EMBODIMENTS

Figure 1:
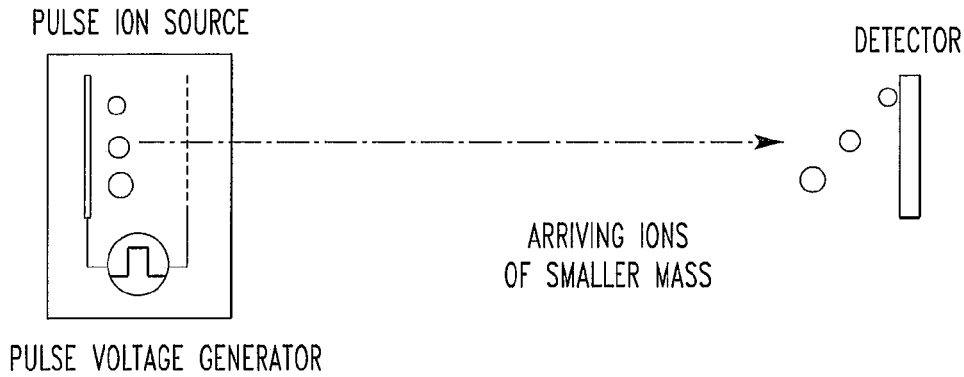
FIG. 1 illustrates one related art linear TOF-MS instrument.
Figure 2:
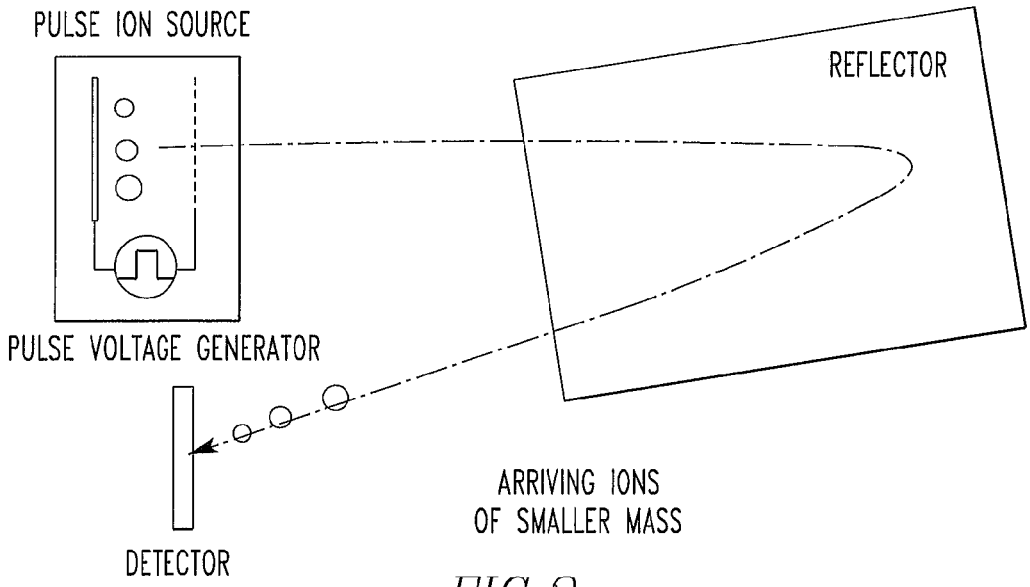
FIG. 2 illustrates one related art reflectron TOF-MS instrument.
Figure 3:
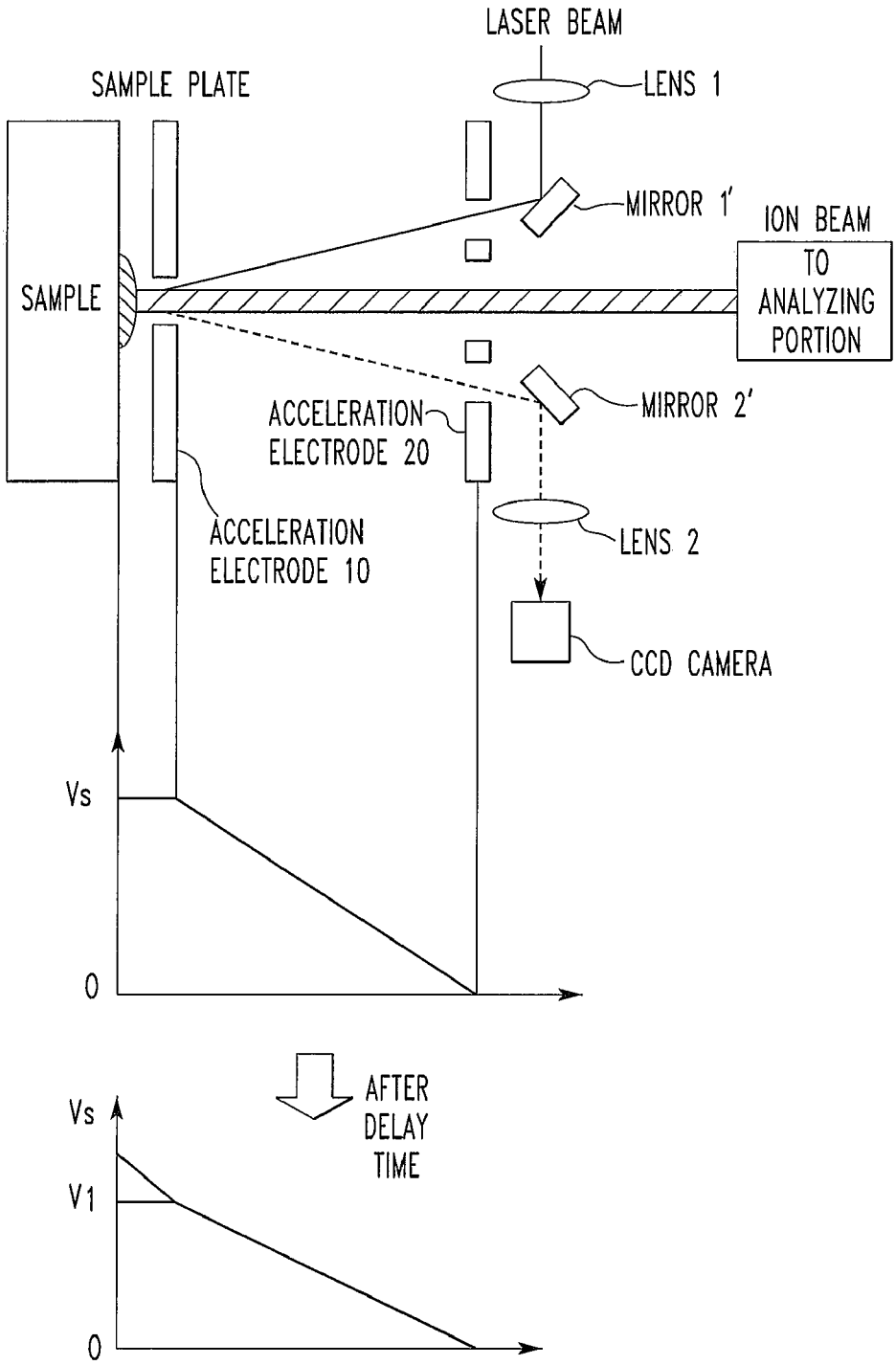
FIG. 3 illustrates one related art MALDI ion source.
Figure 4:
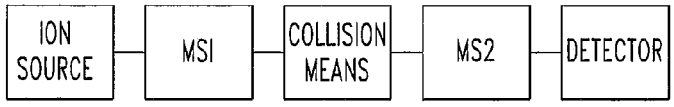
FIG. 4 is a block diagram of one related art MS/MS instrument.
Figure 5:
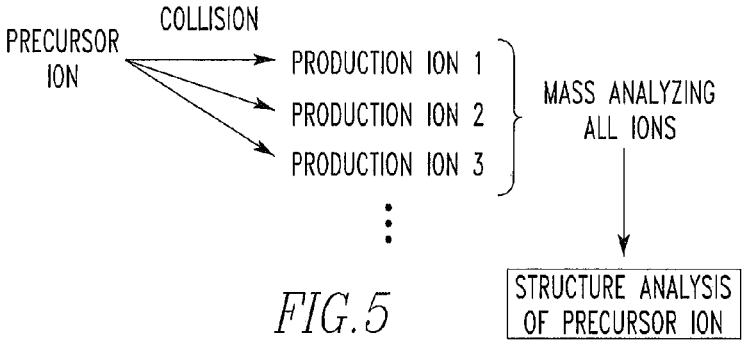
FIG. 5 is a conceptual diagram of related art MS/MS measurements.
Figure 6:
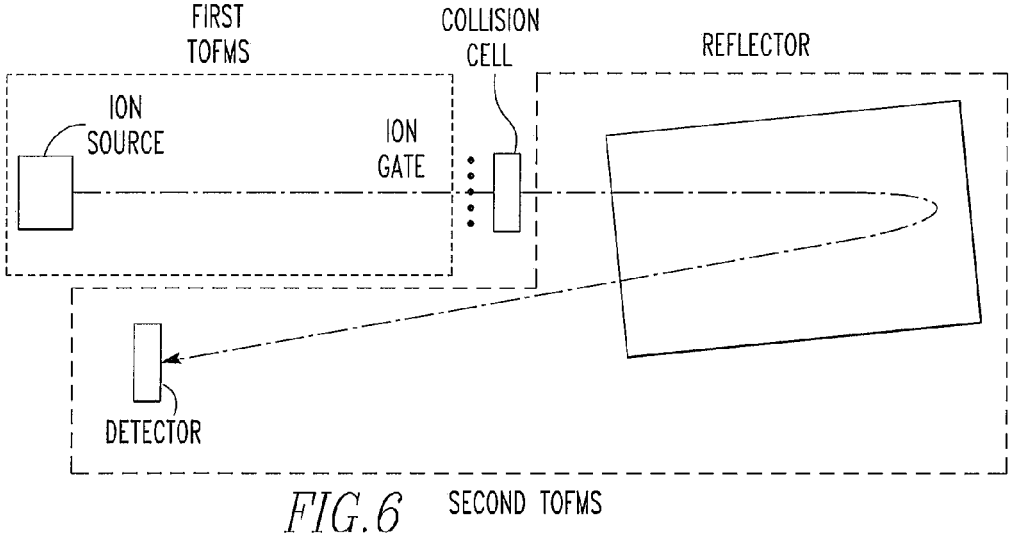
FIG. 6 is a schematic view of one related art TOF/TOF instrument.

The preferred embodiments of the present invention are hereinafter described with reference with the drawings. First, terms used herein are defined as follows (1-3).

1. Instrumental parameters: parameters actually set into an instrument and including fixed parameters in addition to parameters described below.

2. Adjustable parameters: instrumental parameters modified for each m/z value of precursor ions that is adjusted utilizing a known substance.

3. Adjustable parameter table (adjustment table): a table containing plural adjustable parameters.

First Embodiment

The instrumental configuration of the present invention is applicable to every type of TOF/TOF instrument. The advantages of the invention can be enhanced in a case where the instrument is so designed that the flight distance of the first TOF-MS unit is elongated by a reflectron field or sector field to achieve higher precursor ion selectivity. One conceivable example of variable instrumental parameter is the ratio of the sample plate voltage to the pulsed voltage, the ratio being associated with the delayed extraction method. Another example is the delay time itself.

First, a method of setting an ion gate is described. In TOF-MS, a calibration is performed to convert the flight time T into m/z values, using a formula given by $$m/z=C(T) \tag{5}$$

Often, this conversion equation C(x) is a polynomial equation. A time Tg_M for which the ion gate is opened to select ions having an m/z value of M can be represented using Eq. (6) by converting the m/z value into a flight time using a calibration equation and using the value k of the ratio of the distance from the ion source to the ion gate to the distance from the ion source to the detector.

$$Tg_M=kC^{-1}(M) \tag{6}$$

The coefficient k is so adjusted that monoisotopic ions of the precursor ions are selected in a case where the precursor ions are precursor ions A with m/z value of Ma providing a reference.

For example, one conceivable procedure is as follows.

1. First, m/z value of Ma to be selected is set.

2. After obtaining a spectrum, it is confirmed that monoisotopic ions have been selected.

3. In a case where the ion gate opening time is out of order and cannot be appropriately selected, a parameter (ion gate-adjusting value) permitting adjustment of the ion gate open time is modified and then it is confirmed that the time has been appropriately selected.

4. After the confirmation, C (x) is so corrected that the observed m/z value agrees with Ma.

5. The coefficient k is adjusted from the currently set ion gate open time Tg_M and from the adjusted C(x).

$$k=Tg_M/C^{-1}(Ma) \tag{7}$$

6. After the adjustment, the ion gate-adjusting value is set to 0.

Then, plural known substances (e.g., ions having m/z values of $M_0$ and $M_c$; $M_0<Ma<M_c$) which cover a mass range to be measured are measured. At this time, the optimum focusing conditions differ according to different m/z value and so it is necessary to adjust the instrumental conditions for each different ion. Where the instrumental conditions are adjusted, if the same calibration conversion equation as used for Ma is used, the observed m/z value will vary. Consequently, the time for which the ion gate is opened must be set taking account of the amount of variation.

For example, let ΔM be an adjustment value for the ion gate open time. The ion gate open time $Tg_M_0$ of the ion with mass $M_0$ is given by $$Tg_M_0=kC^{-1}(M_0+\Delta M) \tag{8}$$

The adjustable parameter that has adjusted the instrumental conditions and the ion gate-adjusting value are recorded and used as one set of adjustment values stored in the table.

Then, an unknown sample is measured in practice. First, a mass spectrum is measured. A list of m/z values of precursor ions to be measured by MS/MS is made. The precursor ions in the list are successively measured by MS/MS. At this time, instrumental parameters and ion gate-correcting values are calculated according to the m/z values of the ions from the adjustment table already drawn up and are set into the instrument.

Several methods are available as the method for the calculations. Some of them are exemplified in FIGS. 8A, 8B, and 8C. In a first method (FIG. 8A), the spaces between reference values indicating the relations of the instrumental parameters contained in the adjustment table to the m/z values of ions are interpolated by broken lines. Ion gate-correcting values conforming to the m/z values of the ions are calculated. In a second method (FIG. 8B), the spaces between reference values indicating the relations of the instrumental parameters contained in the adjustment table to the m/z values of the ions are interpolated by an approximation equation and ion gate-correcting values conforming to the m/z values of the ions are calculated. In a third method (FIG. 8C), reference values themselves indicating the relations of the instrumental parameters contained in the adjustment table to the m/z values of the ions are regarded as effective within a given range of m/z, and ion gate-correcting values conforming to the m/z values of ions are computed.

Embodiment 2

Generally, as the molecular weight of precursor ions increases, the ionization efficiency deteriorates or the number of fragmentation paths increases. For these and other reasons, the number of ions per fragmentation path tends to decrease. Therefore, a detector voltage or laser intensity that is an instrumental parameter associated with the ionization efficiency may be used as an additional adjustable parameter. This makes it possible to measure spectra of more uniform quality.

Embodiment 3

When precursor ions are selected after measurement of a mass spectrum, relative intensity information about the precursor ions can be obtained in advance. Accordingly, regarding ions with a small amount of precursor ions, a detector voltage or laser intensity that is an instrumental parameter is used as an additional adjustable parameter. Thus, spectra of more uniform quality can be measured.

Embodiment 4

Since the mass positions of precursor ions deviate due to variations in instrumental conditions, it is possible to make a correction such that the m/z value of the precursor ions observed within the product ion spectrum conforms to a preset value after a measurement.

The present invention can be widely used in tandem measurements performed by a time-of-flight mass spectrometer.

Having thus described my invention with the detail and particularity required by the Patent Laws, what is desired protected by Letters Patent is set forth in the following claims.

The invention claimed is:

1. A method of tandem time-of-flight mass spectrometry implemented by a tandem time-of-flight mass spectrometer having: an ion source for ionizing a sample by irradiating it with pulsed laser light to generate ions, acceleration means for extracting the generated ions in a pulsed manner and accelerating the ions by a pulsed accelerating voltage under certain delayed extraction conditions, a first time-of-flight ion optical system permitting the accelerated ions to travel, an ion gate for selecting only ions having a desired mass-to-charge ratio as precursor ions from among the ions mass-separated by the first time-of-flight ion optical system, fragmentation means for fragmenting the selected precursor ions into product ions, a second time-of-flight ion optical system disposed behind the fragmentation means and permitting the product ions to travel, and a detector for detecting ions passed through the second time-of-flight ion optical system, said method comprising the steps of:

drawing up a data table in preparation for measurements of product ions which are generated by selecting desired precursor ions by the ion gate and fragmenting the precursor ions, the table storing measured optimum values of delayed extraction conditions for the mass-to-charge ratios of plural reference substances and measured optimum values of the time for which the ion gate is opened;

finding delayed extraction conditions and open time of the ion gate which optimize mass resolution at the mass-to-charge ratio of the desired precursor ions based on values stored in the table; and setting the found optimum values of the delayed extraction conditions and ion gate open time into the tandem time-of-flight mass spectrometer.

2. A method of tandem time-of-flight mass spectrometry as set forth in claim 1, wherein said delayed extraction conditions include an ion acceleration voltage or a delay time from laser irradiation to the instant at which the ions are accelerated.

3. A method of tandem time-of-flight mass spectrometry as set forth in any one of claim 1 or 2, wherein with respect to the delayed extraction conditions and ion gate open time, delayed conditions and ion gate open time adapted for desired ions are calculated by connecting points stored in the table by broken lines and interpolating between the points.

4. A method of tandem time-of-flight mass spectrometry as set forth in any one of claim 1 or 2, wherein with respect to the delayed extraction conditions and ion gate open time, delayed conditions and ion gate open time adapted for desired ions are calculated by approximating spaces between the points stored in the table by a polynomial equation and interpolating between the points.

5. A method of tandem time-of-flight mass spectrometry as set forth in any one of claim 1 or 2, wherein with respect to the delayed extraction conditions and ion gate open time, delayed conditions and ion gate open time adapted for desired ions are calculated by partitioning each space between any two adjacent ones of the points stored in the table into two subspaces and assigning respective ones of the ink values stored in the table to the subspaces.

6. A method of tandem time-of-flight mass spectrometry as set forth in claim 3, wherein laser intensity or a detector voltage of the mass spectrometer is included as conditions to be set, in addition to the delayed extraction conditions and ion gate open time.

7. A method of tandem time-of-flight mass spectrometry as set forth in claim 6, wherein the laser intensity or the detector voltage of the mass spectrometer is set according to the intensity of the precursor ions.

8. A method of tandem time-of-flight mass spectrometry as set forth in any one of claim 1 or 2, wherein said ion source is a MALDI ion source.

9. A method of tandem time-of-flight mass spectrometry as set forth in any one of claim 1 or 2, wherein said first time-of-flight ion optical system is a time-of-flight ion optical system having precursor ion selectivity that has been enhanced by making use of a reflectron field or sector field.

10. A method of tandem time-of-flight mass spectrometry as set forth in any one of claim 1 or 2, wherein after a measurement, the mass positions of the precursor ions that have deviated due to setting of the delayed extraction conditions are corrected so as to conform with their original values based on m/z values of the precursor ions observed within a product ion spectrum.

11. A tandem time-of-flight mass spectrometer having an ion source for ionizing a sample by irradiating it with pulsed laser light to generate ions, acceleration means for extracting the generated ions in a pulsed manner and accelerating the ions by a pulsed accelerating voltage under certain delayed extraction conditions, a first time-of-flight ion optical system permitting the accelerated ions to travel, an ion gate for selecting only ions having a desired mass-to-charge ratio as precursor ions from among the ions mass-separated by the first time-of-flight ion optical system, fragmentation means for fragmenting the selected precursor ions into product ions, a second time-of-flight ion optical system disposed behind the fragmentation means and permitting the product ions to travel, and a detector for detecting ions passed through the second time-of-flight ion optical system, said tandem flight-of-time mass spectrometer comprising:

a data table in which measured optimum values of delayed extraction conditions for mass-to-charge ratios of plural reference substances and measured optimum values of open time of the ion gate are stored;

means for finding delayed extraction conditions and ion gate open time which optimize mass resolution for each mass-to-charge ratio of the precursor ions based on values stored in the table; and means for setting optimum values of the delayed extraction conditions and ion gate open time into the tandem time-of-flight mass spectrometer according to the value of the mass-to-charge ratio of the selected precursor ions.

* * * * *